US009186292B2

(12) United States Patent
Besendorfer

(10) Patent No.: US 9,186,292 B2
(45) Date of Patent: Nov. 17, 2015

(54) HUMAN JOINT REHABILITATION APPARATUS

(75) Inventor: Jeffrey R. Besendorfer, Heber, UT (US)

(73) Assignee: THERAPEASE MANAGEMENT, LLC, Herber, UT (US)

( * ) Notice: Subject to any disclaimer, the term of this patent is extended or adjusted under 35 U.S.C. 154(b) by 1508 days.

(21) Appl. No.: 11/713,331

(22) Filed: Mar. 2, 2007

(65) Prior Publication Data

US 2007/0149902 A1 Jun. 28, 2007

Related U.S. Application Data

(63) Continuation-in-part of application No. 10/950,850, filed on Sep. 27, 2004, now Pat. No. 7,727,119.

(51) Int. Cl.
*A61H 1/00* (2006.01)
*A61H 1/02* (2006.01)

(52) U.S. Cl.
CPC ..... *A61H 1/0274* (2013.01); *A61H 1/0237* (2013.01); *A61H 2201/1269* (2013.01)

(58) Field of Classification Search
CPC ..... A61H 1/0237; A61H 1/0274; A61H 2201/1269; A61H 1/00; A61H 1/02; A61H 1/024; A61H 1/003; A61H 1/0218; A61H 1/0292; A61H 1/0296; A61H 1/0222; A61H 1/0281; A61H 1/0266; A61H 2201/018; A61H 2201/0173; A61H 2201/164; A61H 2201/1642; A61H 2201/5007; A61H 2201/5023; A61H 2201/5043; A61H 2201/5064; A61H 2201/5079; A61H 2203/04; A61H 2203/0425; A61H 2203/0431
USPC ..... 601/23, 24, 26, 33, 34, 35, 5, 86, 90, 98
See application file for complete search history.

(56) References Cited

U.S. PATENT DOCUMENTS

| | | | | | |
|---|---|---|---|---|---|
| 2,387,966 | A | | 10/1945 | Zander | |
| 3,000,632 | A | | 9/1961 | Fuchs | |
| 4,089,330 | A | | 5/1978 | Nicolosi et al. | |
| 4,487,199 | A | | 12/1984 | Saringer | |
| 4,537,083 | A | | 8/1985 | Saringer | |
| 4,538,595 | A | | 9/1985 | Hajianpour | |
| 4,671,257 | A | | 6/1987 | Kaiser et al. | |
| 4,691,694 | A | * | 9/1987 | Boyd et al. | 601/34 |
| 4,716,889 | A | | 1/1988 | Saringer | |
| 4,844,454 | A | | 7/1989 | Rogers | |
| 4,986,261 | A | * | 1/1991 | Iams et al. | 601/35 |
| 5,078,152 | A | * | 1/1992 | Bond et al. | 600/587 |
| 5,207,216 | A | * | 5/1993 | Sweeny | 601/5 |
| 5,209,223 | A | * | 5/1993 | McGorry et al. | 601/34 |
| 5,228,432 | A | | 7/1993 | Kaiser et al. | |
| 5,239,987 | A | | 8/1993 | Kaiser et al. | |
| 5,258,019 | A | * | 11/1993 | Riddle et al. | 606/242 |
| 5,267,924 | A | | 12/1993 | Miller et al. | |
| 5,297,540 | A | | 3/1994 | Kaiser et al. | |
| 5,300,090 | A | * | 4/1994 | Primic | 601/26 |
| 5,399,147 | A | | 3/1995 | Kaiser | |

(Continued)

*Primary Examiner* — Quang D Thanh
(74) *Attorney, Agent, or Firm* — Steven L. Nichols; Van Cott, Bagley, Cornwall & McCarthy P.C.

(57) ABSTRACT

A human joint rehabilitation apparatus, the apparatus includes a movable platform configured to support a portion of a patient's body including the joint, and a motorized mechanical energy source configured to move at least a portion of the platform to apply motion to the joint, wherein the patient dynamically controls the motorized mechanical energy source to operate the motion of the joint.

22 Claims, 7 Drawing Sheets

(56) References Cited

U.S. PATENT DOCUMENTS

| | | | | | |
|---|---|---|---|---|---|
| 5,421,798 | A | * | 6/1995 | Bond et al. | 601/23 |
| 5,458,560 | A | | 10/1995 | Kaiser et al. | |
| 5,531,658 | A | | 7/1996 | L.S.C. | |
| 5,620,410 | A | | 4/1997 | Kaiser et al. | |
| 5,682,327 | A | * | 10/1997 | Telepko | 601/34 |
| 5,722,937 | A | * | 3/1998 | Smith | 601/23 |
| 5,730,706 | A | * | 3/1998 | Garnies | 601/23 |
| 5,776,084 | A | * | 7/1998 | Wolan | 601/26 |
| 5,913,759 | A | * | 6/1999 | Bostrom | 482/142 |
| 6,106,445 | A | | 8/2000 | Lay | |
| 6,464,652 | B1 | * | 10/2002 | Hubbard et al. | 601/5 |
| 6,692,451 | B2 | * | 2/2004 | Splane, Jr. | 601/5 |
| 7,175,602 | B2 | * | 2/2007 | Diaz et al. | 601/5 |
| 7,381,192 | B2 | * | 6/2008 | Brodard et al. | 601/5 |
| 2002/0045844 | A1 | | 4/2002 | Beny et al. | |
| 2002/0193710 | A1 | * | 12/2002 | Main et al. | 601/5 |
| 2003/0073939 | A1 | | 4/2003 | Taylor et al. | |
| 2004/0087880 | A1 | | 5/2004 | Mason et al. | |
| 2004/0127821 | A1 | | 7/2004 | Ou et al. | |
| 2009/0149783 | A1 | * | 6/2009 | Nef et al. | 601/5 |

* cited by examiner

HUMAN JOINT REHABILITATION APPARATUS

CROSS REFERENCE TO RELATED APPLICATIONS

The present application is a continuation-in-part of U.S. patent application Ser. No. 10/950,850, filed Sep. 27, 2004 now U.S. Pat. No. 7,727,119 to Bessendorfer, et. al., which is herein incorporated by reference in its entirety.

BACKGROUND

Continuous passive motion or manually applied physical therapy to an injured or post operative limb is the primary rehabilitative treatment chosen by most doctors and therapists. Many limb and joint exercising devices are known. Generally, these machines have a motor driven limb support, with the limb support capable of being set to periodically move the limb in a preset range of positions, for a preset length of duration, and at a preset speed. Once these angles, speed, and duration have been chosen, the machine automatically moves the limb from a straightened position back and forth into these pre-chosen positions at the pre-chosen speed for the pre-chosen duration.

Resetting positions and safety cutoffs are available for the user of current machines. However, because all variables are preset and constant, typically, initial therapy cycles of the machine are often too severe and painful, whereas, later therapy cycles are insufficient due to the limbering of the joint and the joint's capability of greater movement as the therapy session progresses. Further, current machines do not allow for total joint isolation, but often require the use of other joints to achieve joint movement (such as hip joint movement in the case of the knee).

Current machines and therapists do not sense the pain of the patient at all and do a limited job of sensing joint stiffness. A machine is needed that will allow total flexibility in the treatment of a joint, including flexion, extension, rotation, duration, and speed, but in doing so, the machine needs to be sensitive to the pain threshold of the patient and the flexibility of the joint being rehabilitated.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

Figure 1:
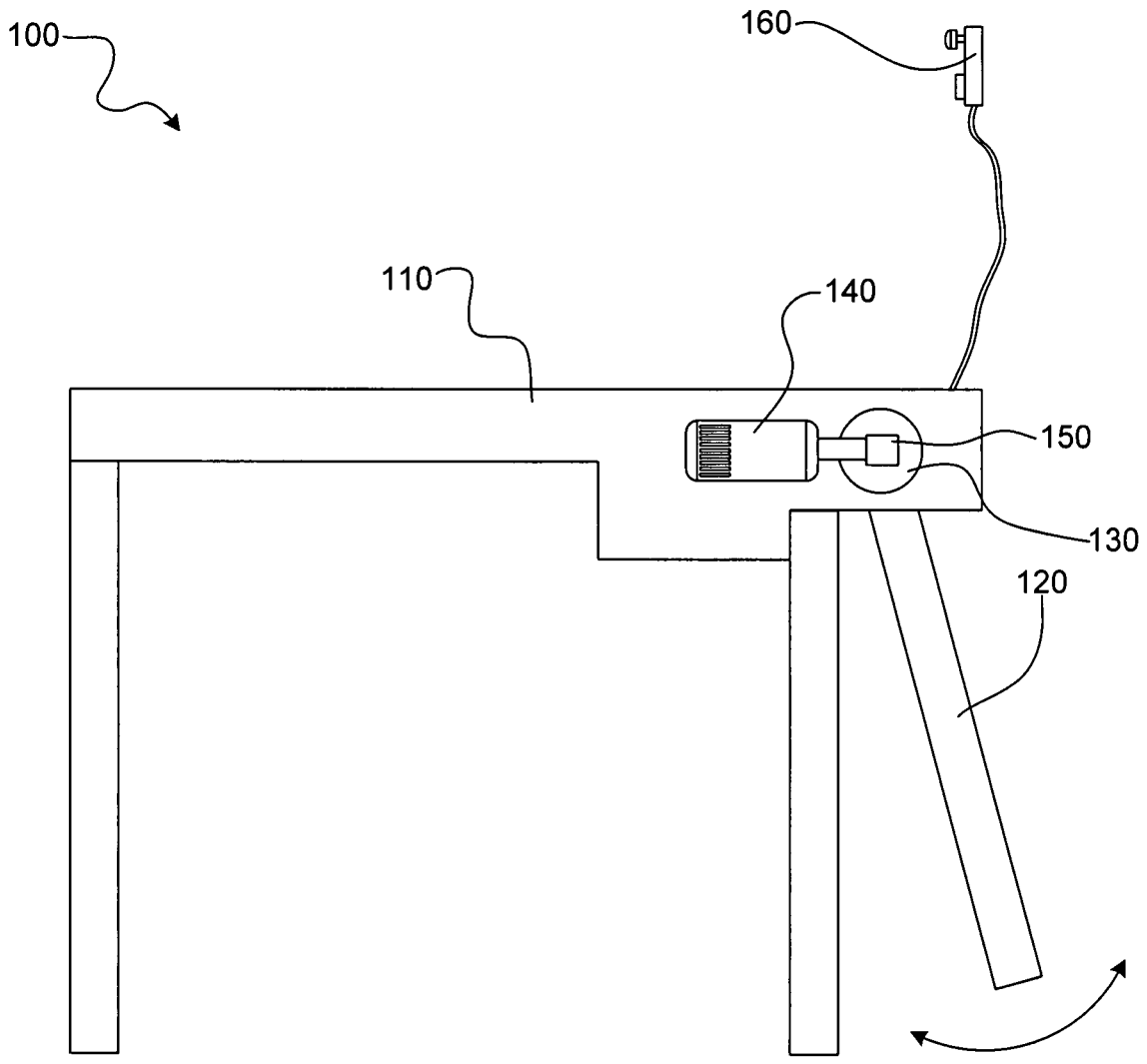
FIG. 1 illustrates a schematic diagram of an exemplary joint rehabilitation apparatus.

A joint rehabilitation apparatus is provided herein that allows for goal setting and attainment by the user. The machine allows for full extension and substantially full flexion of a substantially fully isolated joint. In some embodiments the machine also allows for the controlled rotation of a joint, such as a ball and socket joint. The machine makes therapy more effective and more efficient by putting greater control in the hands of the patient. This machine is useful for the treatment of several conditions, including, but not limited to, intra-articular knee fracture, reconstructed knee ligaments, total knee joint arthroplasty, rotator cuff injuries, tendinitis, bursitis, osteoarthritis, shoulder surgeries, shoulder fractures, shoulder replacements, joint subluxations, joint dislocations, hyperlaxity, structural impingements, functional impingements, microtrauma induced injuries, macrotrauma induced injuries, hip pointers, iliotibial band syndrome, sciatic nerve damage or injury, Legg Calvé Perthe Disease, slipped capital femoral epiphysis, hip surgeries, hip fractures, stress fractures, avascular necrosis, hip replacements, and any other conditions requiring range of motion to be re-established or maintained.

In one exemplary embodiment, the joint rehabilitation apparatus allows the passive exercising of a joint. The exemplary joint rehabilitation apparatus has a table for sitting, to which is attached a motorized mechanical energy source and a limb support mechanism. The motorized mechanical energy source is attached through a power transmission system to the limb support mechanism. When the patient manipulates a dynamic control system, angular motion of the limb support mechanism is precisely controlled so that the patient can easily move his/her own limb through a substantially full range of motion (full extension to substantially full flexion) and/or joint rotation, at a desired speed and hold a position of flexion or extension or at an angle of joint rotation for a desired duration, thereby managing the personal factors of pain and stiffness. Substantially complete isolation of the joint is maintained throughout the flexion, extension, or rotation cycle.

Recognizing that this apparatus may be configured to work with many different joints such as knee joints, shoulder joints, hip joints, elbow joints, and back joints, and powered in many different ways, a general joint rehabilitation apparatus will first be discussed, followed by a brief discussion of a joint rehabilitation apparatus configured for exercising knee joints. Thereafter, the individual sub-assemblies of the joint rehabilitation apparatus will be discussed in detail, including the main frame, the leg support assembly, the drive train assembly, and the patient-operated dynamic control system.

As used in the present specification and appended claims, the terms "dynamic control" and "dynamically controls" refer to the ability of a patient or user to actively control a joint rehabilitation apparatus according to the present specification during flexion, extension and joint rotation exercises. A patient that dynamically controls a joint rehabilitation apparatus accordingly has the ability to control parameters such as starting time, stop time, hold time, angle of flexion, angle of extension and angle of joint rotation during an exercise or therapy session. Furthermore, the terms "dynamic control" and "dynamically controls" imply that a user is not confined to operating a joint rehabilitation apparatus only under operating parameters set at the beginning of the rehabilitation or exercise session.

In the following description, for purposes of explanation, numerous specific details are set forth in order to provide a thorough understanding of the present method and apparatus.

It will be apparent, however, to one skilled in the art, that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Schematic Diagram of a Joint Rehabilitation Apparatus

FIG. 1 is a general schematic view of a joint rehabilitation apparatus (100). The joint rehabilitation apparatus (100) generally includes an upper-limb support (110) such as a table and a lower-limb support (120). The lower-limb support (120) pivots with respect to the upper-limb support (110). Further, the lower-limb support (120) is configured to have a lower part of the limb attached thereto, such that as the lower-limb support (120) is rotated, the lower part of the patient's limb follows. As the lower part of the patient's limb follows the movement of the lower-limb support, the joint is exercised. The motion of the joint as the limb is drawn back on itself is referred to as flexion while the motion of the limb as it is straightened is referred to as extension. The joint may also be rotated with respect to an upper limb, a lower limb or the patient's body. The range between flexion, extension and angular rotation is referred to as range of motion. By independently supporting the upper and lower portions of the patient's limb, the lower portion of the limb alone may be moved through the range of motion, thereby substantially isolating the movement of the joint from the movement of other joints in the limb.

This isolation of the joint to be rehabilitated is further enhanced by providing a motive force separate from the patient's own exertion with respect to the limb and joint to be rehabilitated. For example, if the patient is exercising a knee, the joint rehabilitation apparatus moves the lower leg while minimizing or eliminating the need for the patient to use his/her leg muscles to move the lower leg. The rotational force used to move the lower-limb support (120) may be applied to a pivot (130) that is coupled to the lower-limb support (120).

Further, this motive force is generated by a motorized mechanical energy source such as an electric motor (140), and manipulated through the use of a patient-operated dynamic control system (160). The output of the electric motor (140) may then be transferred from the electric motor (140) to the pivot (130) through a power transmission assembly (150). Accordingly, the joint rehabilitation apparatus (100) is configured to be driven by the electric motor (140) and controlled by the patient-operated dynamic control system (160) while allowing the joint to be exercised in isolation. The joint rehabilitation apparatus such as the one shown (100) may be configured to be used with any joint to be rehabilitated.

It should be understood that other motorized mechanical energy sources may be used to provide the aforementioned motive force. Some examples of motorized mechanical energy sources that may be used in conjunction with apparatus of the present specification include, but are not limited to, motorized hydraulic mechanical energy sources and motorized pneumatic mechanical energy sources.

An exemplary joint rehabilitation apparatus (200) will now be discussed in the context of exercising a knee joint.

Joint Rehabilitation Apparatus

Figure 2:
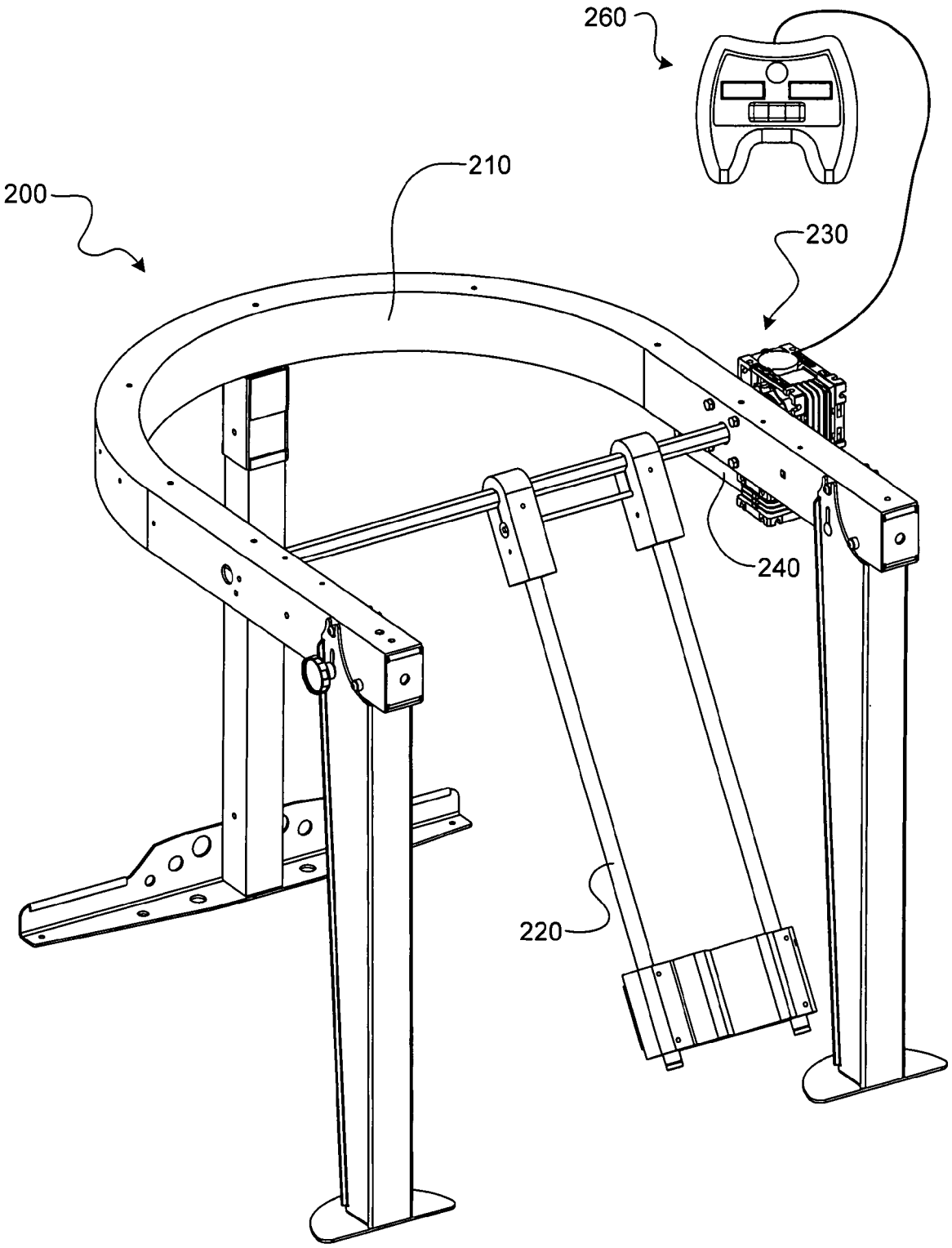
FIG. 2 illustrates a perspective view of an exemplary joint rehabilitation apparatus configured to rehabilitate knee joints.

FIG. 2 illustrates one exemplary joint rehabilitation apparatus (200) that generally includes a support table main frame (210), a leg support assembly (220), a drive train assembly (230), and a patient-operated dynamic control system (260). The main frame (210) is coupled to the leg support assembly (220) and the drive train assembly (230). The patient-operated dynamic control system (260) is in electrical communication with the drive train assembly (230), thus enabling the viewing of data and manipulation of the drive train assembly (230) comfortably by the patient while seated on the joint rehabilitation apparatus (200).

In particular, the leg support assembly (220) is pivotably supported on one end thereof to the main frame (210) and is rotatingly coupled on the other end to the drive train assembly (230). The drive train assembly (230) is then connected to the main frame (210).

The drive train assembly (230) translates the rotation of an electric motor (240), preferably at a substantially reduced ratio, to rotation in the leg support assembly (220). This rotation is accomplished while isolating a single joint and allowing the user to control the range of motion with respect to flexion and extension; speed; and duration, in light of personal factors such as pain and stiffness by using the patient-operated dynamic control system (260). For ease of reference, the joint rehabilitation apparatus will be discussed with reference to the rehabilitation or therapy of a knee joint.

Each of the assemblies includes several components. Accordingly, each assembly will be discussed in more detail. In particular, the components of the main frame (210) will be discussed first, followed by a discussion of the leg support assembly (220), the drive train (230), and the patient-operated dynamic control system (260).

Main Frame

Figure 3A:
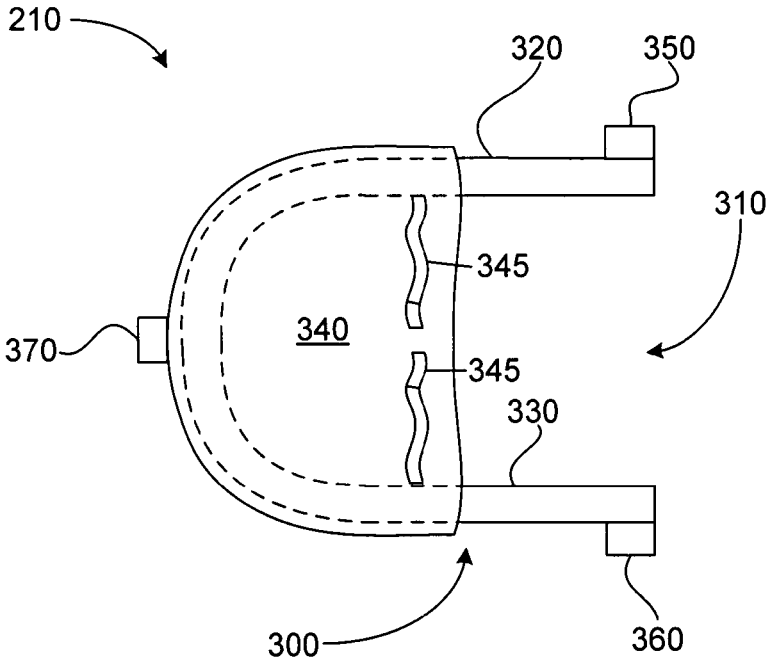
FIG. 3A illustrates a top view of an exemplary main frame.
Figure 3B:
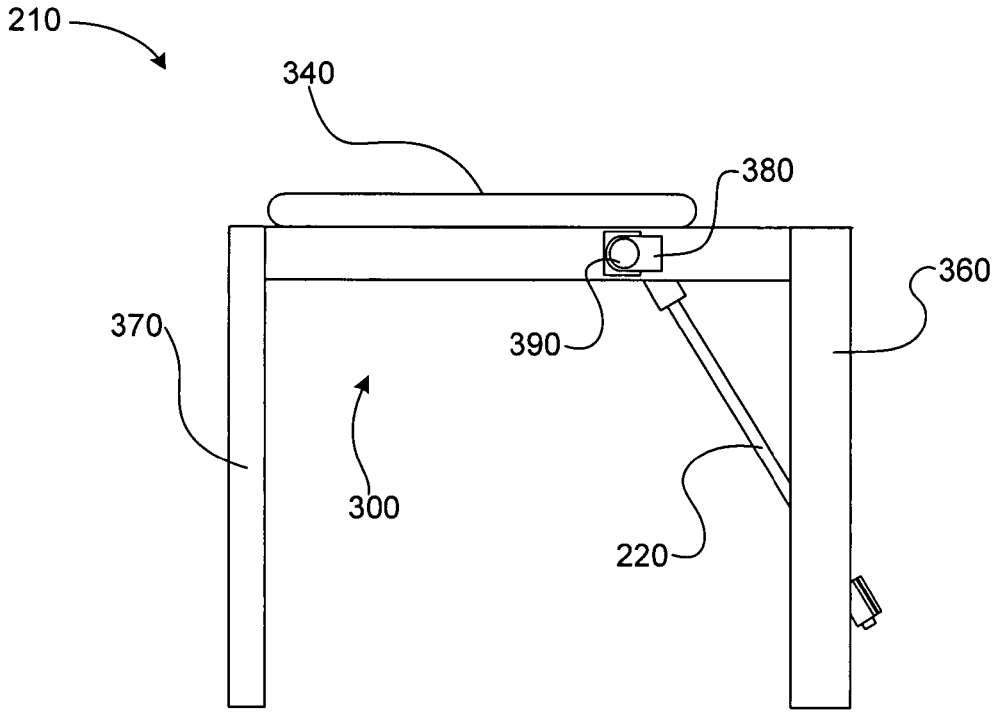
FIG. 3B illustrates a side view of an exemplary main frame.

FIGS. 3A and 3B illustrate the main frame (210). The main frame (210) includes a generally U-shaped sub-frame (300). Accordingly, a gap (310) is defined between opposing arms (320, 330) of the table portion (300). The gap (310) of the exemplary main frame (210) is sized to allow at least one leg to be positioned within the main frame (210) and may be sized to allow both legs to be positioned within the main frame.

The main frame (210) may include a support, such as a generally flat table (340) that extends between the opposing arms to support a patient thereon. In such a configuration, the patient would sit on the table (340) and place the knee to be rehabilitated near the end of the table (340) and within the gap (310). The thigh of the knee to be rehabilitated would be held still by straps (345) attached to the table (340). Consequently, the lower part of the leg would extend beyond the table (340) such that the lower part of the leg would be suspended by the table (340). For convenience, the gap (310) may be sized to allow the patient to extend both legs from the table (340).

The configuration of the main frame (210) helps ensure that the patient is able to move the knee through a substantially full range of motion while minimizing contact between the leg and the ground or other surfaces. The exemplary main frame (210) shown is configured to allow a patient to rest both legs on the table (340), such that the knees are near the end of the table (340) and the lower legs are suspended.

The main frame (210) also includes three legs (350, 360, 370) that support the U-shaped sub-frame (300). These legs (350, 360, 370) are sufficiently long to ensure that the lower portion of the patient's leg does not come into contact with the ground or other surfaces as it moves through its range of motion. In addition, the legs (350, 360, 370) fold up such that the apparatus (100) may be more easily stored or transported. One leg may be configured for removal and use as a transport handle for the apparatus (200)

A feedback mechanism such as an optical incremental encoder reader (380) may be attached to the main frame (210). A corresponding disk (390) may be included attached to the leg support assembly (220) such that any movement of the leg support assembly (230) in relation to the main frame (210) transmits shaft rotation data, such as flexion and extension angle, speed of movement, direction of movement, time duration of flexion and extension exercises, and torque to the patient-operated dynamic control system (260). In this way the data may be easily viewed by the patient. The encoder reader (380) and disk (390) may also be attached at various other points on the drive train assembly (230) and main frame (210). In some embodiments, other feedback mechanisms may provide these data to the patient.

Accordingly, the main frame (210) provides a stable platform to support the joint to be rehabilitated while providing a substantially full range of motion. The main frame (210) is also configured to support the leg support assembly (220) and the drive train assembly (230) in addition to providing a connection point for the patient-operated dynamic control system (260).

Leg Support Assembly

Figure 4:
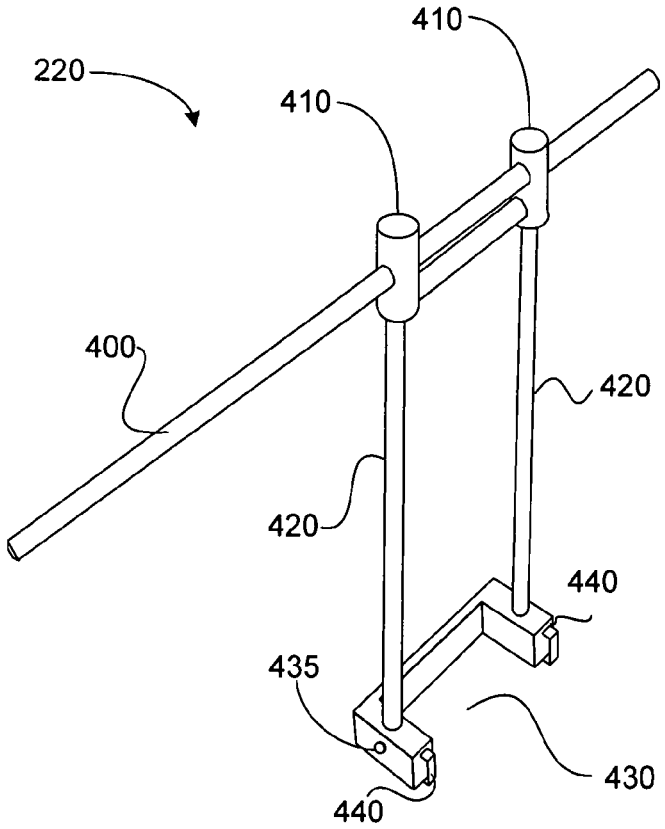
FIG. 4 illustrates an exemplary leg support assembly.

FIG. 4 illustrates the leg support assembly (220) in more detail. The leg support assembly (220) includes lateral adjustments and radial adjustments. These adjustments allow the joint rehabilitation apparatus (200; FIG. 2) to be adapted for use with either leg and for use by patients having limbs of different dimensions. The leg support assembly (220) includes a hexagonal drive shaft (400), shaft sleeves (410), opposing parallel guide rods (420), and a limb attachment mechanism (430).

The shaft sleeves (410) shown slides on bushings which allow the shaft sleeves (410) to be moved laterally along the drive shaft (400). This configuration allows the shaft leg support assembly (220) to be positioned to allow the patient to exercise either leg. For example, if the patient desires to exercise the left knee, the shaft sleeves (410) are moved along the drive shaft (400) until it is in position with respect to the left knee. Accordingly, the mobility of the shaft sleeves allows a patient to use the joint rehabilitation apparatus (200; FIG. 2) with either leg.

In addition to allowing adjustment of the lateral position of the shaft sleeve (410), the leg support assembly (220) is also configured to allow adjustment of the radial distance between the drive shaft (400) and the limb attachment mechanism (430). In particular, the limb attachment mechanism (430) is coupled to the parallel rods (420) via linear glide bushings. These bushings allow the limb attachment mechanism (430) to slide along the parallel rods (420), thereby varying the radial distance from the drive shaft (400) to the limb attachment mechanism (430).

It may be desirable to vary the distance between the drive shaft (400) and the limb attachment mechanism (430) to better accommodate the attachment of a patient's limb to the joint rehabilitation apparatus (200; FIG. 2). For example, the patient is able to slide the limb attachment mechanism (430) until the limb attachment mechanism (430) is at a comfortable location on the leg. Further, because the drive shaft is not centered in relationship to the patient's knee, the radial distance from the drive shaft to the limb attachment mechanism varies as the patient's limb is moved through the flexion and extension cycle.

The leg support assembly (220) includes a locking mechanism (435) coupled to the limb attachment mechanism (430) for securing the limb attachment mechanism (430) in the proper position while the patient is mounting the machine. The limb attachment mechanism (430) also includes strap mounts (440). The strap mounts (440) are configured to allow straps (not shown) to be mounted thereto. The straps may then be used to secure the lower part of a patient's leg to be attached to the limb attachment mechanism (430).

When the lower leg is attached to the limb attachment mechanism (430), the lower leg will follow the limb attachment mechanism (430). The limb attachment mechanism (430) is rotated when the drive shaft (400) is rotated. In particular, the drive shaft (400) has a generally hexagon shape as does the inside of the shaft sleeves (410). This configuration causes the shaft sleeves (410) to rotate with the drive shaft (400). The parallel rods (420) are coupled to the shaft sleeves (410), such that as the drive shaft rotates, so do the parallel rods (420), the limb attachment mechanism (430), and the lower part of the patient's leg. As the lower part of the patient's leg is rotated, the knee joint is exercised.

As introduced, the leg support assembly (220) is coupled to the drive train assembly (230) and the electric motor (240) such that the output of the electric motor (240) drives the leg support assembly (220). The function of the drive train assembly (230) will now be discussed in more detail.

Drive Train Assembly

Figure 5:
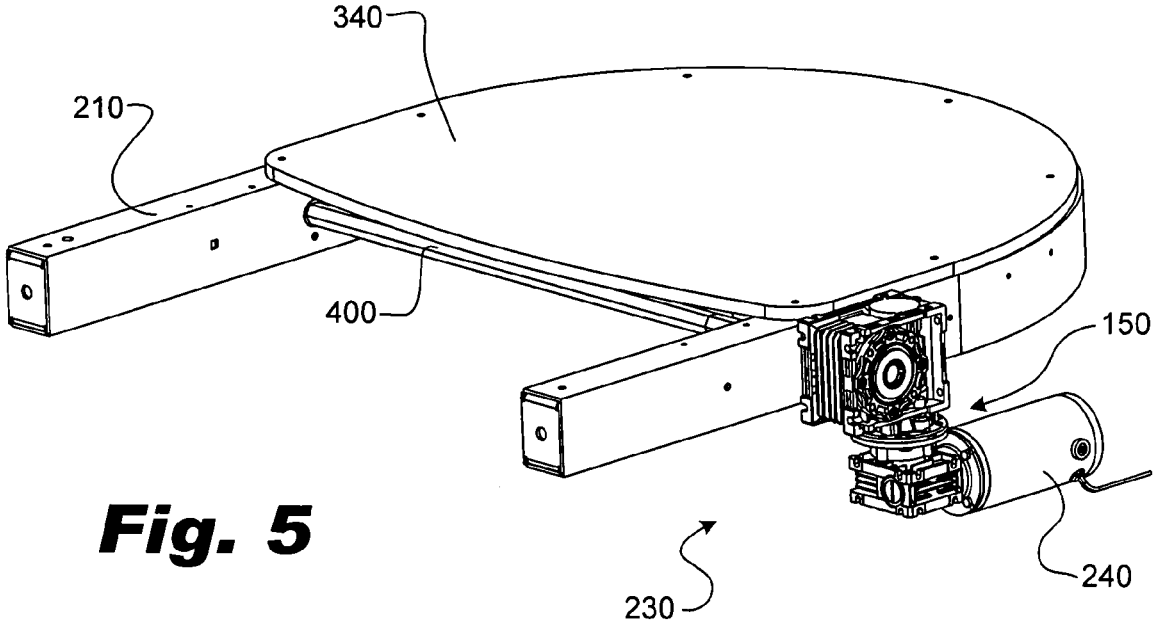
FIG. 5 illustrates an exemplary drive train assembly.

FIG. 5 illustrates the drive train assembly (230) and the main frame (210) with portions of the main frame (210) removed for clarity. The drive train assembly (230) shown in the present embodiment comprises a powered drive system. As seen in FIG. 5, the drive train assembly (230) includes an electric motor (240), and a transmission assembly (150) that is coupled to the drive shaft (400) of the leg support assembly (220; FIG. 2). The drive train assembly (230) is anchored to the main frame (210).

The electric motor (240) converts electrical energy from a power supply to mechanical energy exerted by a rotating shaft. An output of the electric motor (240) is mechanically coupled to an input of the transmission assembly (150). The transmission assembly (150) converts the output of the electric motor (240) into a lower speed, higher torque source of rotational mechanical energy. The transmission assembly (150) may comprise a gear reduction system to accomplish this conversion. The output of the electric motor (240) may be perpendicular to the drive shaft (400). The drive shaft (400) is mechanically coupled to an output of the transmission assembly (150).

The drive train assembly (230) may further be configured to fix the drive shaft (400), and consequentially by extension the leg support assembly (220), at a given position to allow prolonged flexion or retention of the knee joint at a set angle for a desired amount of time.

In this configuration, the drive train assembly (230) allows the speed and direction of the leg support mechanism (220: FIG. 2) to be easily and precisely controlled, thereby allowing the patient to easily and precisely control the angle of flexion and extension, and the speed and duration of each exercise cycle for the knee joint to be rehabilitated.

In other embodiments of the invention, a similar configuration of drive train assembly (230) may comprise a motorized mechanical energy source configured to multi-axially rotate the leg support mechanism (220: FIG. 2) or another limb support mechanism such as a shoulder support mechanism (see FIGS. 8A and 8B). In such embodiments the joint to be rehabilitated may be rotated with respect to an upper limb, a lower limb or another portion of the patient's body, such as during rehabilitation exercises for a torn shoulder rotator cuff.

Patient Operated Dynamic Control System

Figure 6A:
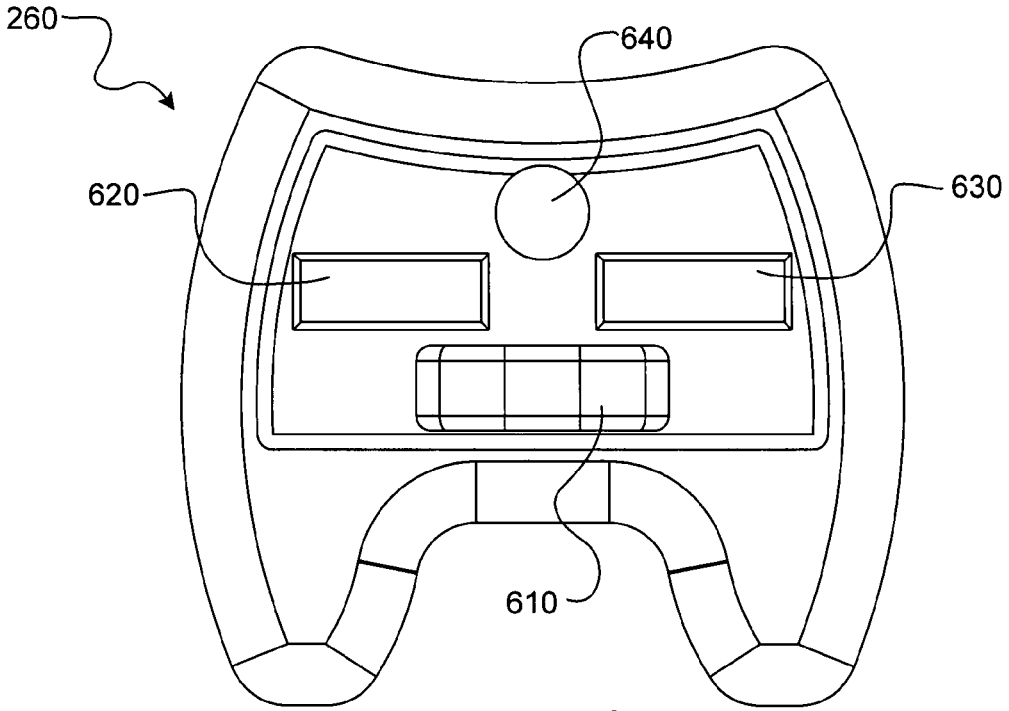
FIGS. 6A and 6B illustrate an exemplary patient-operated control assembly.
Figure 6B:
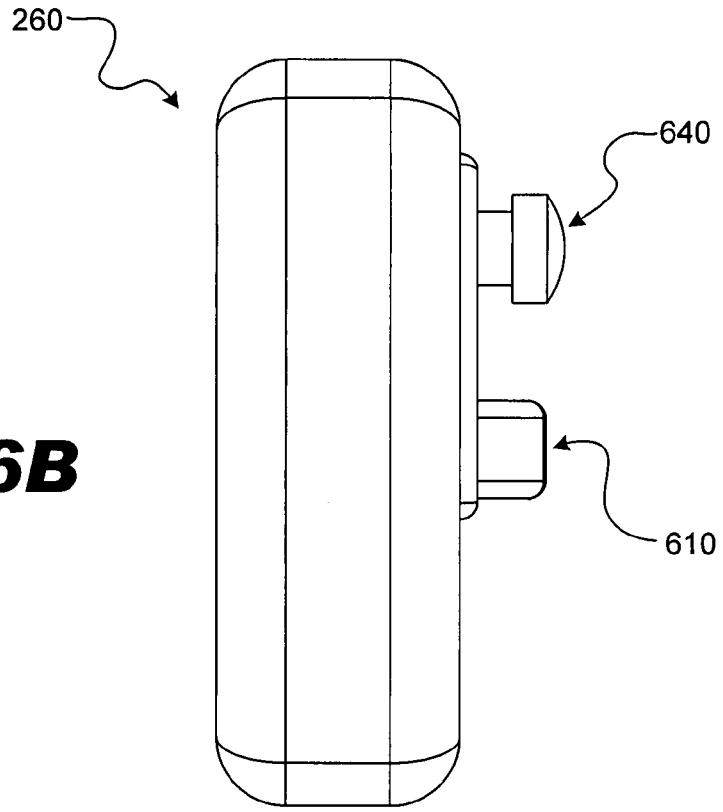

FIG. 6 illustrates the patient-operated control system (240). The patient-operated dynamic control system (260) is in electrical communication with the electric motor (240; FIG. 5) and configured to adjust positioning of the leg support assembly (220; FIG. 2) by controlling the electric motor (240; FIG. 5) in response to input from the patient. The patient-operated control system (240) may be configured to control the electric motor (240; FIG. 5) in such a way as to allow the patient dynamic control of factors such as speed, direction, and duration of flexion and extension rehabilitation cycles. In some embodiments the patient-operated dynamic control system (260) may be configured to control factors such as angle, speed, direction, and duration of joint rotation cycles.

In the exemplary patient-operated dynamic control system (260) shown, input from the patient is received by means of a control mechanism (610) such as a joystick or rocker pot to control the speed and direction of the electric motor (240; FIG. 5) and an emergency shutoff switch (640) for situations requiring the immediate ceasing of a rehabilitation cycle. Additionally, the patient-operated control system (240) may provide feedback data to the user from the optical reader (380; FIG. 3) or another feedback mechanism through display modules (620, 630). For example, one display module (620) may be configured to provide flexion, extension and/or rotation angle feedback and another display module (630) may be configured to provide time data through a clock, stopwatch, or timer display.

In some embodiments the patient-operated dynamic control system (260) may be additionally configured to display torque and speed information. The dynamic control system (260) allows the patient to view essential feedback and precisely control important factors of the rehabilitation cycle such as speed, duration, angle of rotation, and angle of flexion and extension. Furthermore, in some situations the control input from the patient may be influenced by physical stimuli experienced by the patient such as a sensation of pain or stiffness in the joint being rehabilitated.

Electrical connections between the patient-operated dynamic control system (260), the electric motor (240; FIG. 5) and the optical reader (380; FIG. 3) may be achieved through the use of flexible wiring secured to the patient-operated dynamic control system (260) and at least one point of the main frame (210; FIG. 2). The flexible wiring may allow the dynamic control system (260) to be held or mounted so that it may be viewed comfortably in any number of positions by a patient positioned on the table (340; FIG. 3).

Exemplary Apparatus

Figure 7A:
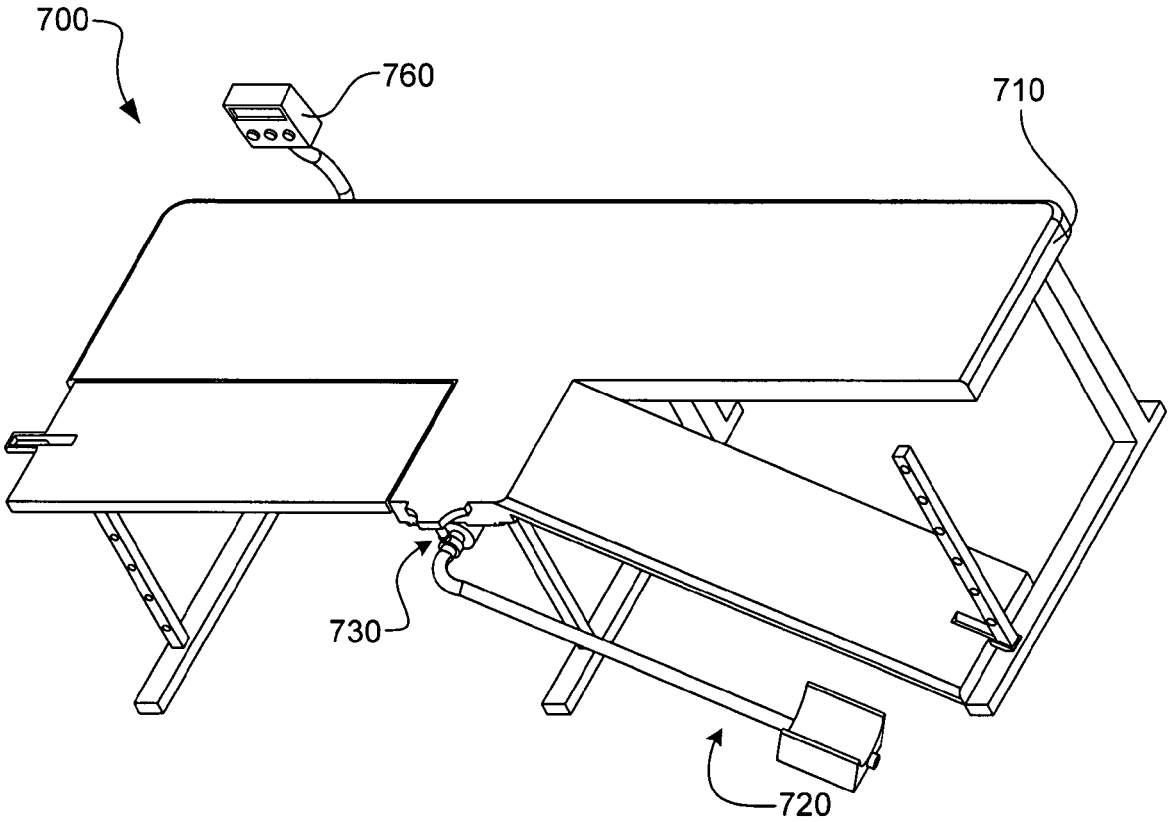
FIGS. 7A and 7B illustrate an exemplary joint rehabilitation apparatus configured to rehabilitate hip joints.
Figure 7B:
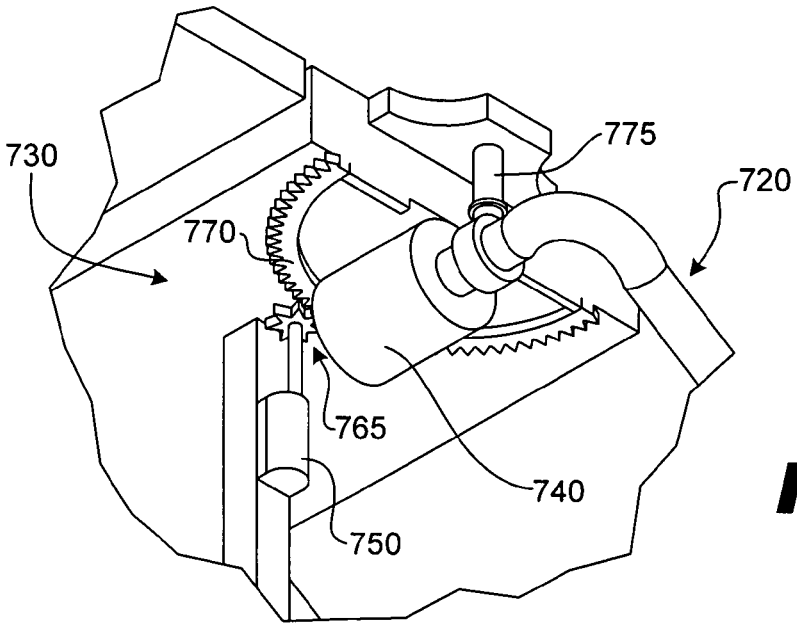

Referring now to FIGS. 7A and 7B, an exemplary apparatus (700) is shown configured to rehabilitate a hip joint by providing multi-axial motion to the joint. The apparatus comprises a main frame (710) and patient-operated dynamic control system (760) similar to those described in relation to previous figures. A patient may sit or lie down on the apparatus (700) while positioning a leg of the hip to be exercised on a leg support assembly (720). By moving the leg support assembly (720) with the patient positioned in this manner, the hip joint to be exercised is substantially isolated. The leg support assembly (720) of this embodiment is configured to provide not only flexion and extension, but also abduction motion to a hip joint. The apparatus (700) comprises a power train assembly (730) configured to provide multi-axial motion to the leg support assembly (720) and thus to the hip joint of the patient.

Referring specifically to FIG. 7B, the power train assembly (730) of this embodiment is shown in more detail. The power train assembly (730) comprises a first electric motor (740) configured to provide flexion and extension motion to the leg support assembly (720). The leg support assembly (720) may be in mechanical communication with an output shaft of the first electric motor (740).

A second electric motor (750) may be mounted to the main frame (710, FIG. 7A) and comprise an output shaft having a first gear (765) configured to rotate a second gear (770) to which the first electric motor (740) and leg support assembly (720) are attached. When the second gear (770) is rotated, the first electric motor (740) and leg support assembly (720) may rotate at a pivot (775) attached to the main frame (710, FIG. 7A) thereby providing abduction motion to the patient's hip joint when the patient's leg is mounted on the leg support assembly (720).

The degree, intensity, speed, and duration of flexion, extension, or abduction motion, along with other parameters may be adjusted by the patient using the patient-operated dynamic control system (760), as has been previously discussed in relation to other figures. Furthermore, in some embodiments, the patient-operated dynamic control system (760) may be in wireless communication with the power train assembly (730) to allow the patient greater versatility in adjusting the parameters of the joint exercise.

Figure 8A:
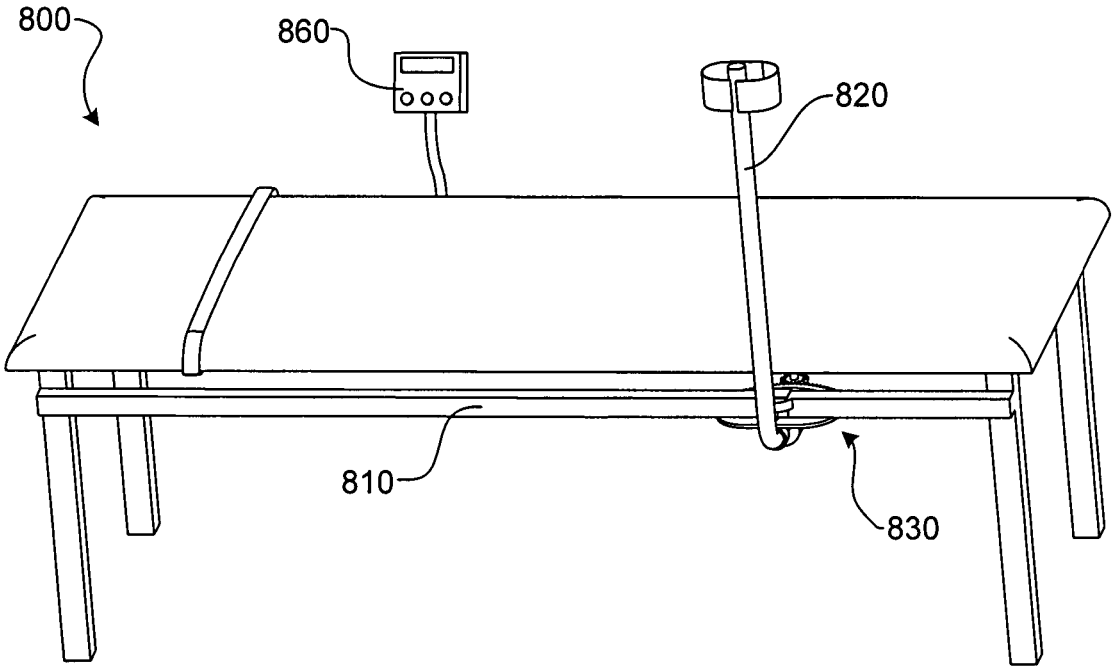
FIGS. 8A and 8B illustrate an exemplary joint rehabilitation apparatus configured to rehabilitate shoulder joints.
Figure 8B:
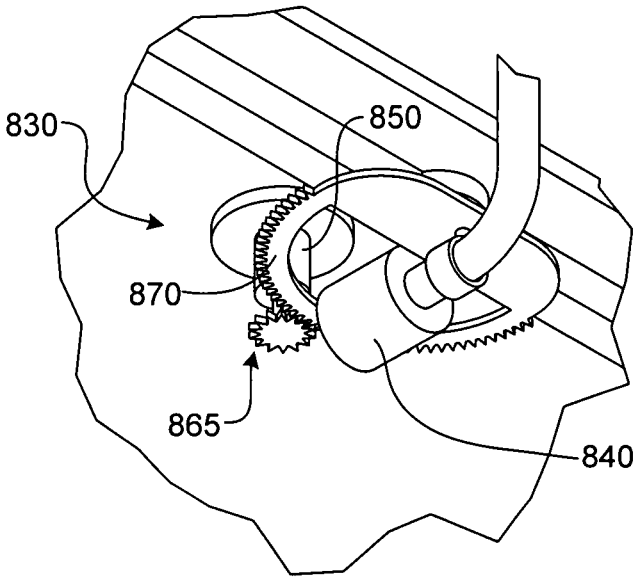

Referring now to FIGS. 8A and 8B, an exemplary apparatus (800) is shown configured to rehabilitate a shoulder joint by providing multi-axial motion to the joint. The apparatus comprises a main frame (810) and patient-operated dynamic control system (860) similar to those described in relation to previous figures. A patient may sit or lie down on the apparatus (800) while positioning an arm of the shoulder joint to be exercised on an arm support assembly (820). By moving the arm support assembly (820) with the patient positioned in this manner, the shoulder joint to be exercised is substantially isolated. The arm support assembly (820) of this embodiment is configured to provide flexion, extension, and abduction motion to a shoulder joint. The apparatus (800) comprises a power train assembly (830) configured to provide multi-axial motion to the arm support assembly (820) and thus to the shoulder joint of the patient.

Referring specifically to FIG. 8B, the power train assembly (830) of this embodiment is shown in more detail. The power train assembly (830) comprises a first electric motor (840) configured to provide flexion and extension motion to the arm support assembly (820). The arm support assembly (820) may be in mechanical communication with an output shaft of the first electric motor (840).

A second electric motor (850) may be mounted to the main frame (810, FIG. 8A) and comprise an output shaft having a first gear (865) configured to rotate a second gear (870) to which the first electric motor (840) and arm support assembly (820) are attached. When the second gear (870) is rotated, the first electric motor (840) and arm support assembly (820) may rotate at a pivot attached to the main frame (810, FIG. 8A) thereby providing abduction motion to the patient's shoulder joint when the patient's arm is mounted on the arm support assembly (820).

The degree, intensity, speed, and duration of flexion, extension, or abduction motion, along with other parameters may be adjusted by the patient using the patient-operated dynamic control system (860), as has been previously discussed in relation to other figures. In some embodiments, the patient-operated dynamic control system (860) may be in wireless communication with the power train assembly (860) to allow the patient greater versatility in adjusting the parameters of the joint exercise.

In conclusion, a joint rehabilitation apparatus has been described herein that allows for goal setting and attainment by the patient. The apparatus allows for full extension and substantially full flexion of a substantially fully isolated joint in addition to providing angle of flexion, extension, and/or abduction feedback to the patient. The apparatus also gives the patient precise control over the speed and duration of the flexion, extension, and/or abduction of a joint. The machine makes therapy more effective and more efficient by putting greater control in the hands of the patient.

The machine is useful for the treatment of several conditions, including, but not limited to, intra-articular knee fracture, reconstructed knee ligaments, total knee joint arthroplasty, rotator cuff injuries, tendinitis, bursitis, osteoarthritis, shoulder surgeries, shoulder fractures, shoulder replacements, joint subluxations, joint dislocations, hyperlaxity, structural impingements, functional impingements, microtrauma induced injuries, macrotrauma induced injuries, hip pointers, iliotibial band syndrome, sciatic nerve damage or injury, Legg Calvé Perthe Disease, slipped capital femoral epiphysis, hip surgeries, hip fractures, stress fractures, avascular necrosis, hip replacements, other joint conditions. and any other conditions requiring range of motion to be re-established or maintained.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the disclosure be defined by the following claims.

What is claimed is:

1. A device for rehabilitating a human knee joint following a knee joint arthroplasty to restore range of motion to the knee joint, the device comprising:

a seat for supporting a knee joint arthroplasty patient, including supporting an upper leg of the patient;

a moveable lower leg support assembly sized and positioned for supporting and moving a lower leg of the patient independent of support for the upper leg of the patient, the moveable lower leg support assembly comprising a limb attachment mechanism for securing the lower leg of the patient to the moveable lower leg support assembly so as to be able to isolate and to cause both flexion and extension of the knee joint of the patient, the moveable lower leg support assembly being pivotally attached to the device adjacent the seat;

a motor connected to the moveable lower leg support assembly for driving the moveable lower leg support assembly to produce both flexion and extension of the knee joint of the patient through a full range of motion of the knee joint such that the patient need not use his or her leg muscles to cause the flexion and extension of the knee joint;

an encoder for measuring position and speed of the moveable lower leg support assembly when being driven by the motor;

a patient control device communicating with both the encoder and the motor, wherein the patient control device comprises a display for displaying to the patient information about the position of the lower leg support assembly based on output from the encoder; and wherein the patient control device is programmed to accept user input to control the motor to control the position and speed of the moveable lower leg support assembly, such that, using the patient control device, the patient, at any and all times during use of the device, dynamically controls the motor to control specifically whether, to what extent and for how long the knee joint experiences flexion or extension, dynamically controlling the motor meaning that the user is not confined to operating the knee rehabilitation device only under operating parameters set at a beginning of a rehabilitation session, but, during the rehabilitation session, has control to move his or her own knee through a full range of motion between extension and flexion, at a desired speed, and to hold any position of flexion or extension of the knee joint for any desired duration, thereby directly managing personal factors of pain and stiffness in the knee joint following arthroplasty.

2. The device of claim 1, further comprising a drive train assembly having a transmission assembly for converting an output of the motor to a lower speed and higher torque for driving the moveable lower leg support assembly.

3. The device of claim 2, wherein the transmission assembly comprises a gear reduction system.

4. The device of claim 1, wherein the encoder comprises an optical reader and corresponding disk such that relative rotation between the reader and disk is sensed by the reader.

5. The device of claim 1, further comprising a drive shaft that is driven by the motor and on which the moveable lower leg support assembly is mounted.

6. The device of claim 5, wherein the moveable lower leg support assembly is slidably mounted on the drive shaft so as to slide laterally along the drive shaft between a first position for rehabilitating a patient's right knee and a second position for rehabilitating a patient's left knee.

7. The device of claim 5, wherein the drive shaft has a hexagonal cross-section matched to a hexagonal shape of an interior of the moveable lower leg support assembly such that rotation of the drive shaft translates to rotation of the moveable lower leg support assembly.

8. The device of claim 5, wherein the drive train assembly is configured to fix the drive shaft at a static location to prolong flexion or extension of the knee joint until released by further patient input.

9. The device of claim 1, wherein the limb attachment mechanism is slidably mounted so as to slide along a length of the moveable lower leg support assembly so as to accommodate knee joint arthroplasty patients with legs of different lengths.

10. The device of claim 9, wherein the moveable lower leg support assembly comprises two parallel rods on which the limb attachment mechanism is slidably mounted.

11. The device of claim 1, wherein the patient control device further displays to a patient a duration of the extension or flexion of the knee joint.

12. The device of claim 1, wherein the patient control device further records for a patient a duration of extension or flexion of the knee joint and an extent of the extension or flexion of the knee joint for reporting progress of the patient in rehabilitation of the knee joint.

13. A method for rehabilitating a human knee joint following a knee joint arthroplasty to restore range of motion to the knee joint, the method comprising:

supporting a knee joint arthroplasty patient, including supporting an upper leg of the patient;

with a moveable lower leg support assembly, moving a lower leg of the patient, that is secured to the moveable lower leg support assembly with a limb attachment mechanism, so as to isolate the knee joint and cause both flexion and extension of the knee joint of the patient to restore range of motion following the knee joint arthroplasty;

wherein a motor connected to the moveable lower leg support assembly drives the moveable lower leg support assembly to produce both flexion and extension of the knee joint of the patient through a full range of motion of the knee joint such that the patient need not use his or her leg muscles to cause the flexion and extension of the knee joint, with an encoder for measuring position and speed of the moveable lower leg support assembly; and receiving patient input and displaying data to the patient with a patient control device communicating with both the encoder and the motor, wherein the patient control device comprises a display for displaying to the patient an indication of a position of the lower leg support assembly based on output from the encoder; and wherein the patient control device is programmed to accept user input to control the motor to control the position and speed of the moveable lower leg support assembly, such that, using the patient control device, the patient, at any and all times during use of the device, dynamically controls the motor to control specifically whether, to what extent and for how long the knee joint experiences flexion or extension, and wherein, separate from parameters set prior to commencing therapy, the patient dynamic control system dynamically controls a hold time at a particular position of flexation or extension under control of the patient.

14. The method for rehabilitating a human knee joint of claim 13, further comprising:

if a patient experiences pain beyond a threshold the patient wants to tolerate, receiving patient input through the patient control device to relax the knee joint away from a current point of flexion or extension; and responsive to the patient input, driving the motor to change a position of the knee joint to make the patient more comfortable.

15. The method for rehabilitating a human knee joint of claim 13, further comprising:

receiving patient input indicating the knee joint is to be extended or flexed to a particular angle; and responsive to the patient input, moving the moveable lower leg support assembly with the motor to extend or flex the knee joint to the particular angle indicated by the patient input.

16. The method for rehabilitating a human knee joint of claim 13, further comprising adjusting a position of the limb attachment mechanism on the moveable lower leg support to accommodate a length of the lower leg of the patient so as to effect flexion and extension of the knee joint for rehabilitation.

17. The method for rehabilitating a human knee joint of claim 13, further comprising adjusting a position of the moveable lower leg support assembly to receive either a right or left lower leg of the patient for rehabilitation of either a right or left knee of the patient.

18. The method for rehabilitating a human knee joint of claim 13 further comprising displaying to the patient an indication of a current angle of extension or flexion of the knee joint.

19. The method for rehabilitating a human knee joint of claim 13 further comprising displaying to the patient an indication of duration of current extension or flexion of the knee joint.

20. A device for rehabilitating a human knee joint to restore range of motion to the knee joint, the device comprising:

an assembly positioned to move a patient's lower leg so as to cause both flexion and extension of a knee joint independent of support for an upper leg of the patient, the assembly for moving the patient's lower leg comprising a limb attachment mechanism for securing the lower leg of the patient to the assembly so as to be able to isolate and to cause both flexion and extension of the knee joint of the patient;

a motor connected to the assembly which actuates the assembly, such that the patient's muscles are not required to move the knee joint; and a patient control device connected to the motor, wherein the patient control device can accept patient input to dynamically control the motion of the assembly, dynamically control meaning that the user is not confined to operating the knee rehabilitation device only under operating parameters set at a beginning of a rehabilitation session, but, during the rehabilitation session, has control to move his or her own knee through a full range of motion between extension and flexion, at a desired speed, and to hold any position of flexion or extension of the knee joint for any desired duration, thereby directly managing personal factors of pain and stiffness in the knee joint following arthroplasty.

21. The device of claim 20, further comprising a hexagon shaped drive shaft between the motor and the assembly, wherein the assembly further comprises at least one shaft sleeve with a hexagonally shaped interior to receive the drive shaft.

22. The device of claim 21, wherein the at least one shaft comprising two shaft sleeves to receive the drive shaft, each shaft sleeve being connected to one of a pair of parallel guide rods which support the limb attachment mechanism.

* * * * *